US005564592A

United States Patent [19]

Martin et al.

[11] Patent Number: 5,564,592

[45] Date of Patent: Oct. 15, 1996

[54] COVER ASSEMBLY FOR A BEVERAGE DISPENSER

[75] Inventors: Herman H. Martin; John Coppa, both of Torrington, Conn.; Kenneth Arsenault, Ware, Mass.

[73] Assignee: Wilshire Partners, Torrington, Conn.

[21] Appl. No.: 326,859

[22] Filed: Oct. 21, 1994

[51] Int. Cl.[6] ..... B65D 25/00

[52] U.S. Cl. ..... 220/724; 220/254; 220/326; 220/338

[58] Field of Search ..... 220/3.8, 4.22, 220/241, 242, 252, 254, 324, 326, 337, 338, 341, 724, 730, 731; 222/129.1, 505

[56] References Cited

U.S. PATENT DOCUMENTS

| | | | |
|---|---|---|---|
| 3,086,676 | 4/1963 | Dilatush | 220/338 |
| 4,234,096 | 11/1980 | Hergaux | 220/254 |
| 5,078,297 | 1/1992 | Howard et al. | 220/533 |
| 5,183,175 | 2/1993 | Brown | 220/408 |
| 5,228,584 | 7/1993 | Williams, Jr. | 220/3.8 |
| 5,233,722 | 8/1993 | McKnight et al. | 220/338 X |

OTHER PUBLICATIONS

Two pages describing the Selmix/Alco "fast flow valve" and showing the cover for that valve in the disassembled state Published Nov. 1, 1987.

Two pages showing the Selmix/Alco "liberty" valve and the cover for that valve in the dissembled state Published Nov. 1, 1987.

Two pages showing valve cover component for the "Sabre" valve Published Nov. 1, 1987.

*Primary Examiner*—Stephen K. Cronin

*Attorney, Agent, or Firm*—Vickers, Daniels & Young

[57] ABSTRACT

A cover assembly for a beverage dispensing valve is provided having an easily accessibly front opening covered by a front cover which can be either swung open or separated from the main housing. The cover assembly is interconnected by pintles and gudgeons with the pintles removable from the gudgeons through guideways.

12 Claims, 4 Drawing Sheets

COVER ASSEMBLY FOR A BEVERAGE DISPENSER

BACKGROUND OF THE INVENTION

1. Field of the Invention.

The present invention relates to a cover assembly for beverage dispensers and particularly for the dispensing valves of a post-mix beverage dispenser.

2. Description of the Related Art

Beverage dispensers are found in many locations including restaurants, amusements parks, sports facilities, and other locations where people eat and drink. Beverage dispensers are used to dispense a variety of beverages including colas and other popular soft drinks. In post-mix beverage dispensers, a beverage syrup is mixed with carbonated or uncarbonated water at the dispensing valve and dispensed into a container for consumption. The beverage dispensers operate in a wide variety of environments. At amusements parks, beverage dispensers are often exposed to extremes of temperature from close to freezing to hot summer afternoons. The beverage dispenser sometimes operate infrequently and sometimes face near continuous use. Occasionally, the characteristics of the syrup supplied to the beverage dispenser will change.

The beverage dispensers referred to above are often in locations subject to public view. The beverage dispensers are often in locations in which area and volume is at a premium and every square inch of counter space is important. Because of the varied demands and exposure to the public of these beverage dispensers, they must be easily serviceable, attractive and inexpensive to manufacture.

Beverage dispensing valves are often disposed in groups as part of a larger ice and beverage dispensing assembly. Two or more beverage dispensing valves will be positioned in front of or below the main body of the ice and beverage dispensing assembly. Individual valves are contained within individual beverage dispensing valve cover assemblies. These cover assemblies are generally box-like two piece devices. A main cover has an open bottom in which the valves mechanical portions are placed and an open front normally covered by a front cover. The main cover is fixed to the valve itself by means of a screw. The front cover is fixed to the main cover by tabs fixed into indentations. The front cover often carries an electrical switch wired to the valve itself and sometimes a light. The cover assembly protects the valve from contamination and also covers the adjusting screws preventing tampering with the valve. Improper adjustment can interfere with proper proportioning of syrup and carbonated water resulting in an inferior beverage being dispensed. The front covers need to be removable from the main cover to allow access by servicemen. When removed, the front cover is completely free of the main cover or suspended from the main cover by the electrical wires connecting to the light or push button switch alone. Neither of these conditions are desirable. If the front cover is completely disassociated from the main cover in a multiple valve arrangement, the front cover can be put back on the wrong main cover resulting in mislabeled drinks. It can also be dropped and damaged. If the front cover is held to the main cover by the electrical wires only the wires can be stressed and broken resulting in damage to the valve body and an inoperable dispenser. Moreover, because of the front cover is normally tightly fixed to the main cover it can be easily damaged during the disassembly or assembly process, especially when disassembled by an inexperienced technician.

Disassembly of the above described dispensing valve covers and other similar dispensing valve covers becomes even more difficult when the valve bodies are disposed directly below an ice chest or marketing panel. It is common practice to have a large panel bearing advertising material directly above a battery of dispensing valves. In such arrangements, these dispensing valves are normally disposed one next to each other with very little clearance between them. A service technician will have very little or no room beside a valve and little space on top of a valve to be serviced. Because of these restrictions, valve covers are often removed less than gently resulting in damage to the cover, especially the front cover.

SUMMARY OF THE INVENTION

In accordance with the present invention, a cover assembly for a beverage dispensing valve is provided having a main cover and a front cover with the front cover rotatably hinged on the main cover providing access without disassembly.

Still further in accordance with the invention, a cover assembly for a beverage dispensing valve is provided having a main cover and a front cover with the front cover easily detachable from the main cover while being rotatably hinged to the main cover.

Still further in accordance with the invention a cover assembly for a beverage dispensing valve is provided having a main cover having a partial front panel and a front opening, said front opening being closable by a front cover which is rotatable upon the main cover and easily detachable from the main cover for access to the interior thereof.

Yet further in accordance with the present invention, a cover assembly for a beverage dispensing valve is provided having a main cover with a front opening and two side walls. Each side wall is provided with guideways leading to circular gudgeon openings adapted to accept button-like pintles on the front cover whereby the front cover can be rotated with respect to the main cover or easily removed from the main cover and reassembled.

It is an object of the present invention to provide an improved cover assembly for a beverage dispensing valve obviating the above described problems which is mechanically simple and inexpensive to manufacture.

It is another object of the present invention to provide a cover assembly for beverage dispensing valve which will provide access to adjusting screws without the need to disassemble the cover assembly.

It is still another object of the present invention to provide a cover assembly for a beverage dispensing valve which allows access to adjusting screws by either swinging a front cover away or removing the front cover.

It is still another object of the present invention to provide a cover assembly for a beverage dispensing valve having a removable front cover portion and a main cover having a front portion whereby electrical switches and lighting may be mounted on the main cover only.

The invention may take physical form in certain parts and arrangements of parts, a preferred embodiment of which will be described in detail in the specification and illustrated in the accompanying drawing which form a part hereof and wherein.

PREFERRED EMBODIMENT

Figure 1:
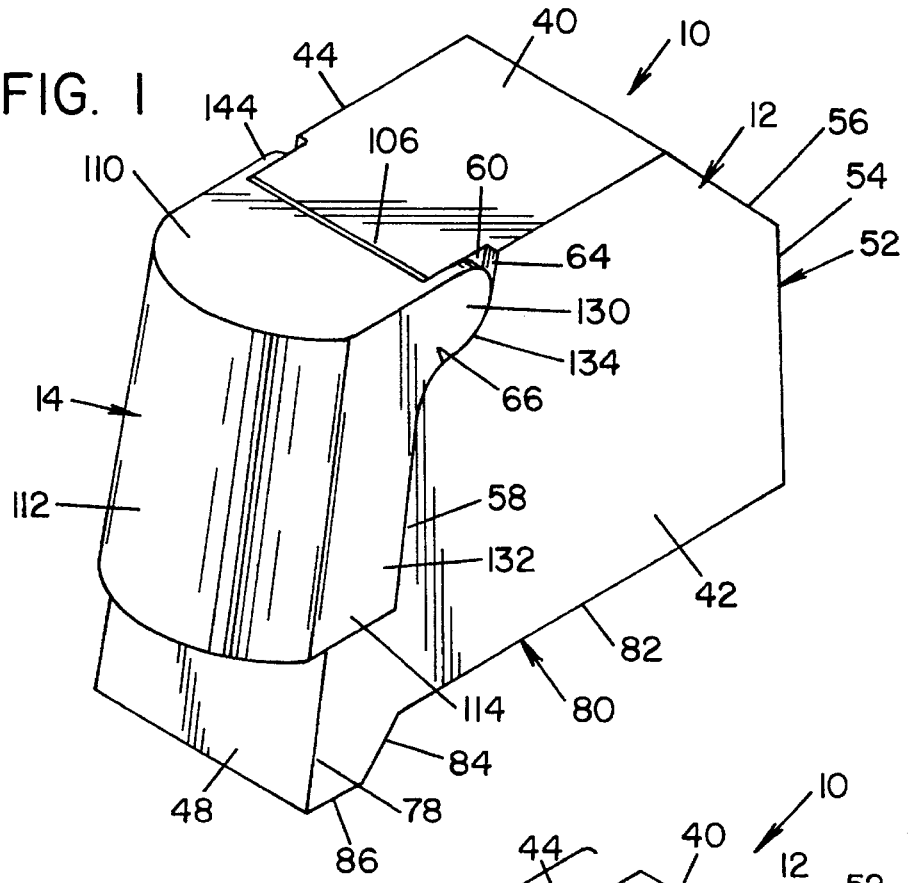
FIG. 1 is a perspective view of the cover assembly for a beverage dispensing valve of the present invention in the assembled condition.

Referring now to the drawings wherein the showings are made for the purposes of illustrating the preferred embodiment of the invention and not for the purposes of limiting same, the figures show a cover assembly for a beverage dispensing valve 10 comprised of a generally boxed-shaped main cover 12 and a front cover 14.

Figure 3:
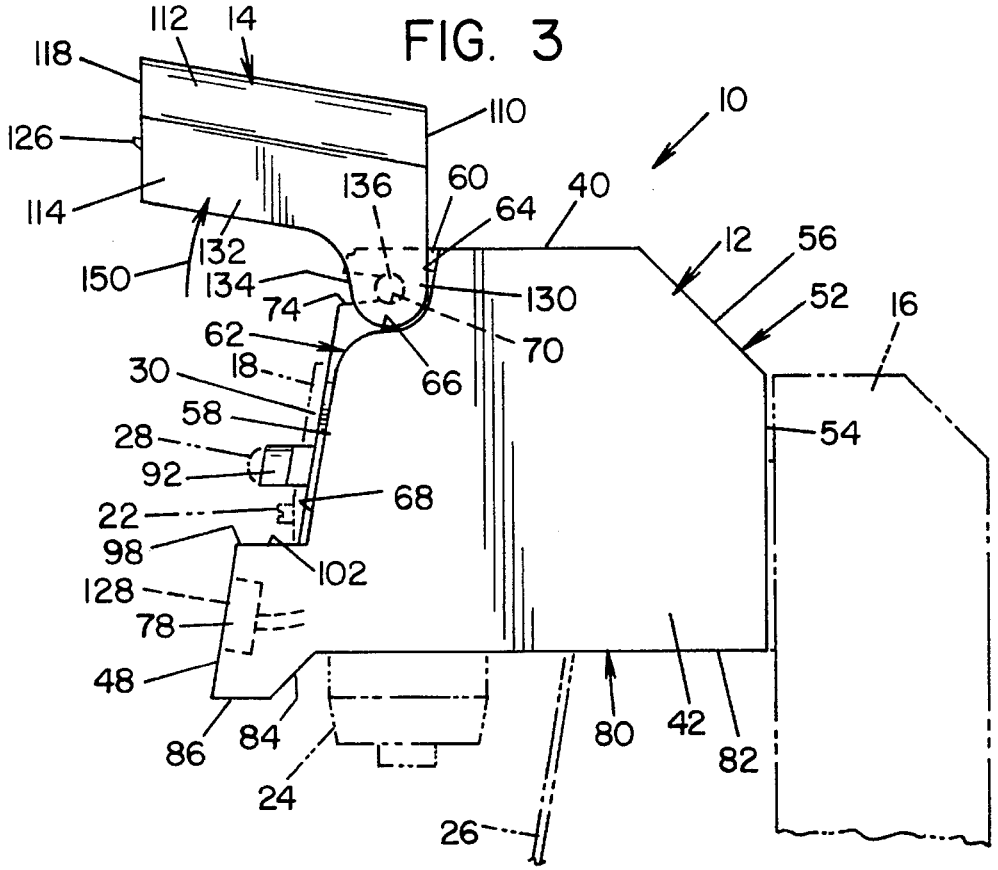
FIG. 3 is a side elevation of the cover assembly seen in FIGS. 1 and 2 showing the front cover rotated to its open position and showing associated valve parts and mounting means in phantom.
Figure 4:
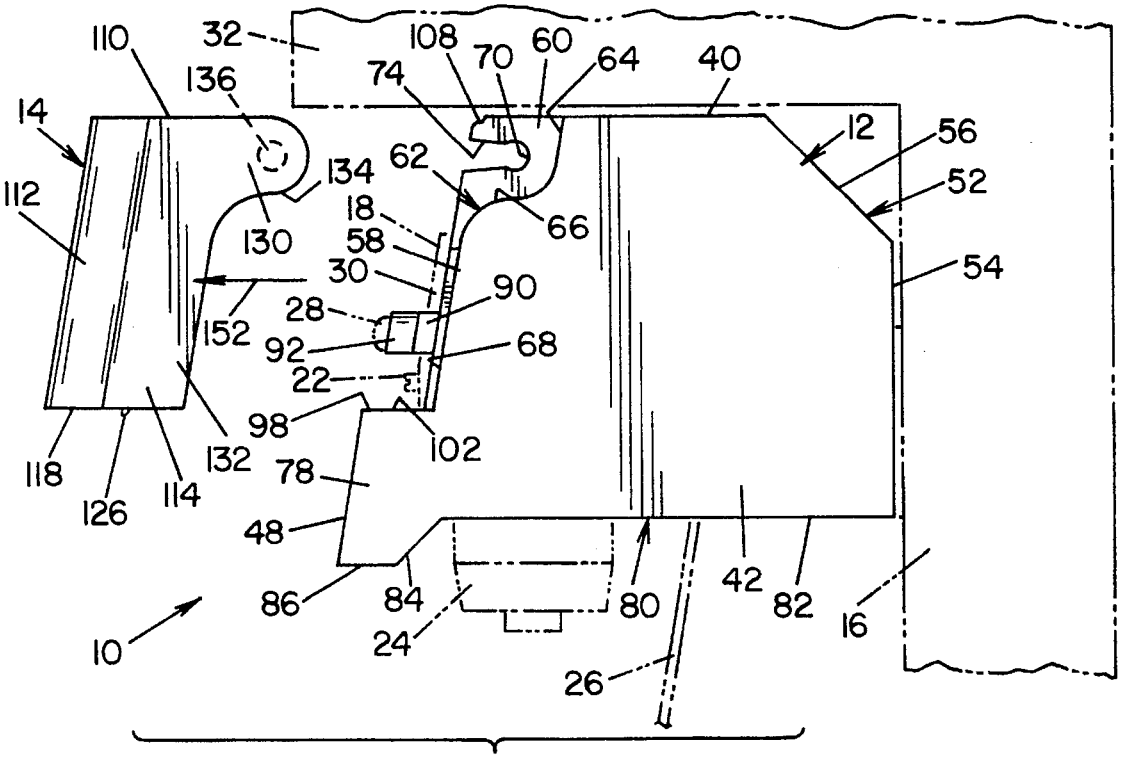
FIG. 4 is a side elevation of the cover assembly of FIGS. 1–3 showing the front cover detached from the main cover and the entire assembly in a different environment from that seen in FIG. 3.

As seen in FIG. 3, the cover assembly 10 is often supported on a tower 16. A beverage dispensing valve 18 is disposed within the cover assembly 10. The beverage dispensing valve 18 includes adjusting screws 20, 22 which are used to set the flow rates of syrup and soda to achieve a quality drink. The mixed syrup and soda is dispensed through a nozzle 24 when an actuator 26 is pushed back by a cup below the nozzle 24. The cover assembly 10 is held on the valve 18 by means of a mounting screw 28. The mounting screw 28 and the adjusting screws 20, 22 are all accessible through a opening 30 in the main cover 12 normally closed by the front cover 14. As can be seen in FIG.4, some towers 16 include an overhang portion 32 which extends horizontally above the valve 18 and cover assembly 10.

Figure 2:
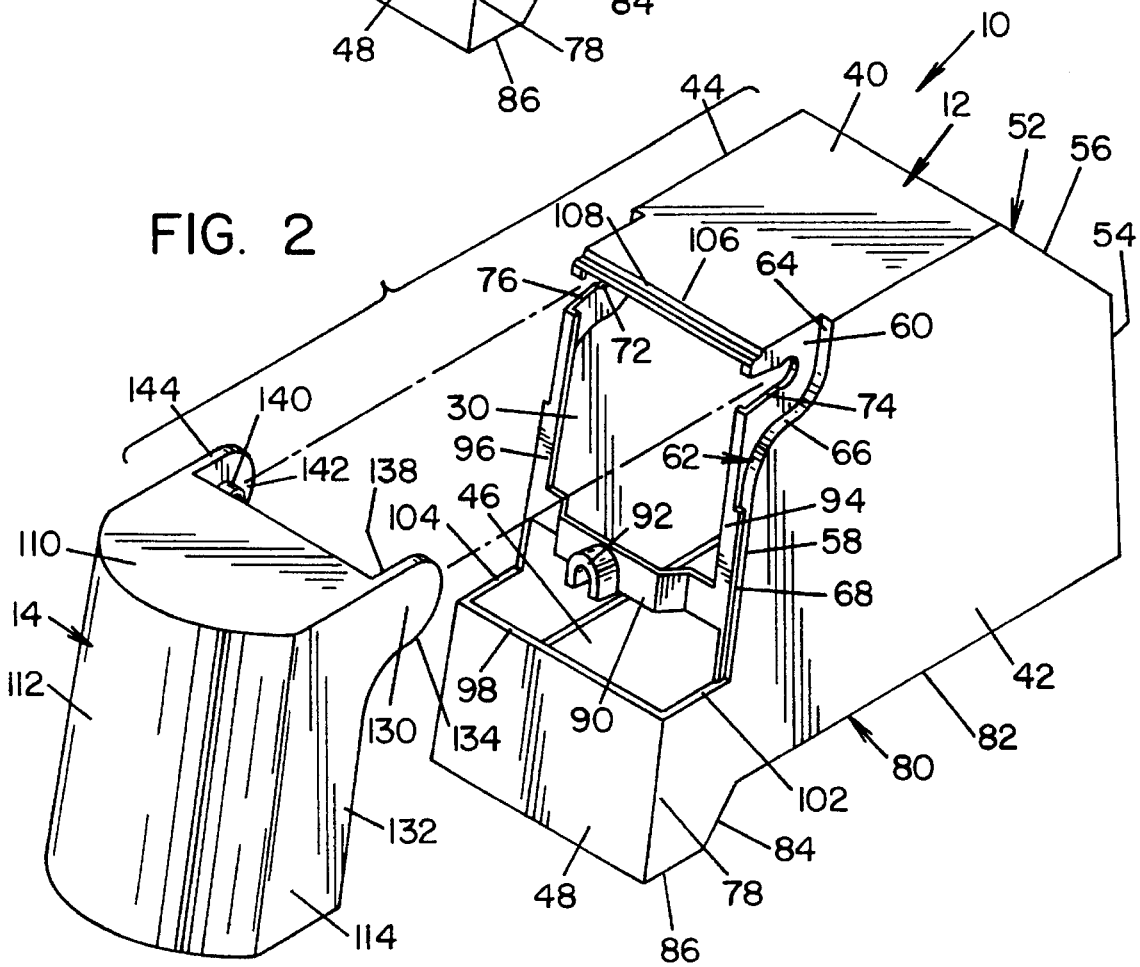
FIG. 2 is a perspective view of the cover assembly of FIG. 1 with the front cover disassembled from the main cover.
Figure 7:
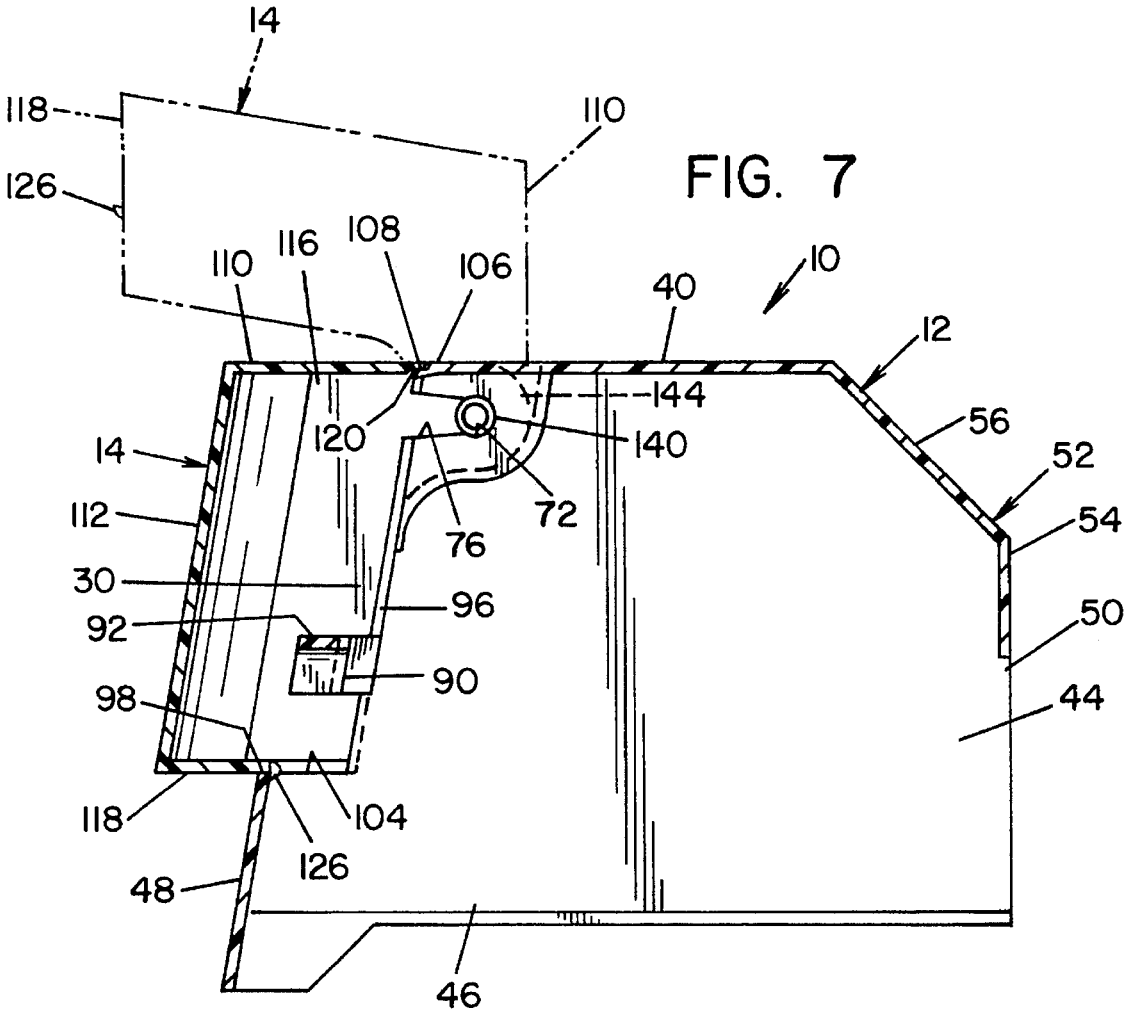

Referring to FIG. 2, the main cover 12 comprises a horizontal top wall 40 a right side wall 42, a left side wall 44, a bottom opening 46, a front wall portion 48, a front opening 30, a rear opening 50 (FIG. 7) and a rear wall portion 52. The rear wall portion 52 includes a vertical portion 54 and an oblique portion 56. The rear opening 50 and the bottom opening 46 accommodate the working portions of the valve 18. All other surfaces of the valve are normally covered by the cover assembly 10.

As can be seen best in FIG. 2, the right side wall 42 is generally planar with straight edges where the side wall joins the rear opening 50, rear wall portion 52 and top wall 40. The front edge 58 of the right side wall 42 is more complex in shape. The upper front portion 60 of the right side wall 42 is slightly recessed with respect to the rest of the right side wall. The recess boundary 62 includes an upper straight portion 64 an intermediate S-shaped curved portion 66 and a lower straight portion 68 as can be seen with respect to the left side wall 44, the upper front portion 60 projects inwardly with respect to the remainder of the side wall 44 so that an adequate wall thickness for mechanical strength is maintained. A circular hole or gudgeon 70 is provided in the recessed upper front portion 60 of the right side wall 42. A identical gudgeon 72 is provided in the recessed upper front portion of the left side wall 44. A tapered guideway 74 connects the gudgeon 70 to the front opening 30. The tapered guideway is cut entirely through the upper front portion 60 of the side wall 42. It has a width slightly less than the diameter of the gudgeon 70 where it joins the gudgeon 70. From the gudgeon 70 it tapers outwardly to have a width slightly greater than the diameter of the gudgeon 70 where it intersects the front opening. 30. An identical tapered guideway 76 is provided in the left side wall 44. The side wall 42 also includes a lower front portion 78 which extends forwardly beyond the lower straight portion of the front edge 58 and downwardly from the bottom of the main portion of the right side wall 42. The lower edge 80 of the right side wall 42 comprises a rear horizontal portion 82 an intermediate oblique portion 84 and a forward horizontal portion 86. The main cover 12 left side wall 44 is a mirror image of the right side wall 42.

The front of the main cover 12 consists of the front wall portion 48 which extends between the lower front portion 78 of the right side wall 42 and an identical lower front portion on the left side wall 44. The front opening 30 is disposed above the front wall portion 48. A mounting cross bar 90 extends across the front opening 30 and includes a U-shaped screw positioner 92. The cross bar 90 is connected to a right hand cross bar support 94 and a left hand cross bar support 96. The two cross bar supports 94, 96 are mirror images of one another. They are integral with the front edge 58 of the side walls 42, 44 and substantially perpendicular to the side walls. The cross bar supports 94, 96 stiffen the front edges 58 of the side walls, preventing distortion and also provide mechanical strength at the point of attachment of the cross bar 90.

The bottom of the front opening 30 is defined by the top edge stop 98 of the front wall portion 48, the top edge 102, 104 of the two lower front portions 78 of the side walls 42, 44 and the forward edge 106 of the top wall 40. The forward edge 106 of the top wall 40 is provided with a rabbet 108.

The front wall portion 48 is planar and has sufficient area to accommodate a touch sensitive switch and/or indicator like. In certain dispensing applications, a momentary contact switch is disposed behind the front wall portion 48 and labeled "water". This switch allows one to obtain water only from a dispensing valve which would normally dispense water and a flavoring syrup when the actuator 26 was depressed. Additionally, a light indicating an out-of-service condition can be disposed behind the front wall portion 48 and a hole cut through the wall portion allowing the light to pass. This structure provides the advantage that wiring to visually apparent switches and/or lights 128 is made on the main cover 12 only. Wiring does not need to go to the front cover 14.

Figure 5:
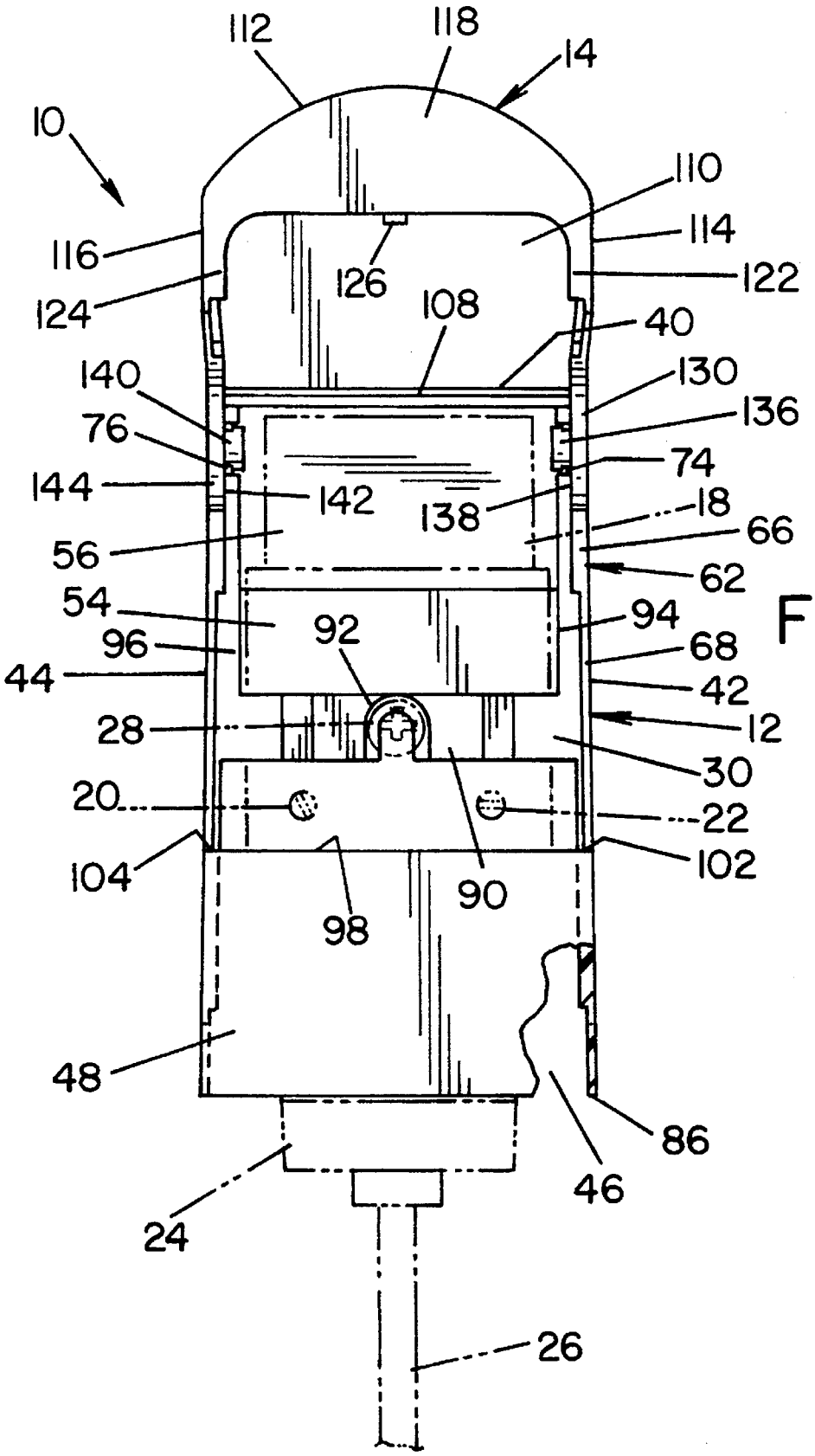
FIG. 5 is a front elevational view of the cover assembly of FIGS. 1–4, partially cut away, showing the enclosed valve assembly and phantom.
Figure 6:
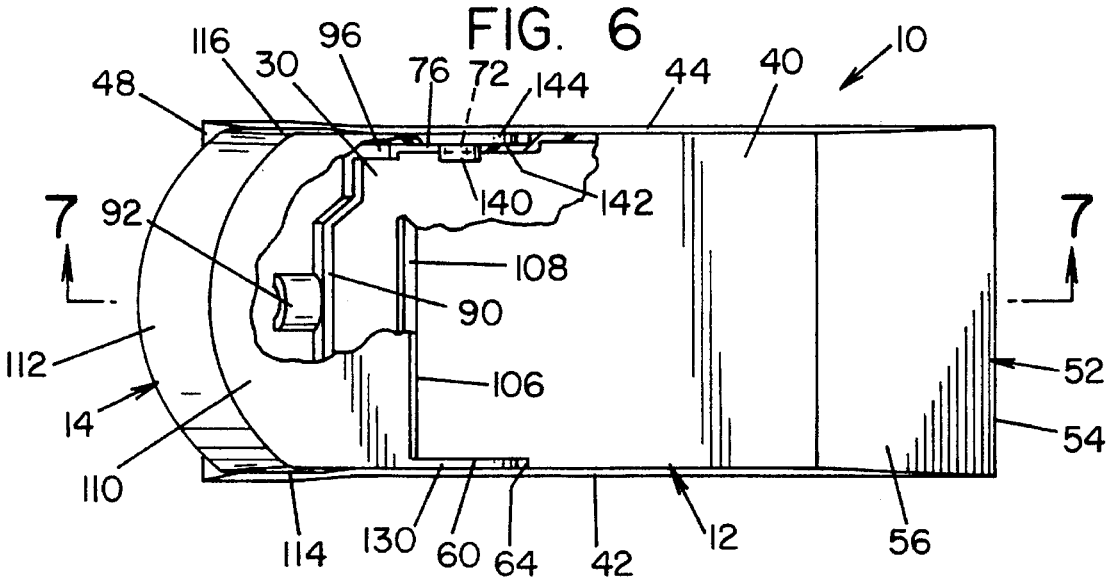
FIG. 6 is a top view of the cover assembly of FIGS. 1–5 partially cut away to show interior details; and, FIG. 7 is a cross section of the cover assembly of FIG. 6 taken along line 7—7.

The front cover 14 is a unitary structure comprised of a top wall 110, a curved front wall 112, a right wall 114, a left wall 116 and a bottom wall 118. The top wall 110 has a rabbet 120 fitting the rabbet 106 in the top wall 40 of the main cover. This provides a tight protective joint along the top surface of the cover assembly 10 when the front cover 14 is in the closed portion. The bottom wall 118 (best seen in FIG. 5) is essentially planar and has a curved forward edge coextensive with the bottom of the front wall 112 and the rear of the bottom wall 118 include a right rearward extending outer portion 122 and a left rearward extending outer portion, 124 extending for most of the length of the right and left walls 114, 116. The outer portions 122, 124 contact the top edges 102, 104 of the lower front portions of the side walls 42, 44 of the main cover 12 when the front cover 14 is in the closed position. In this position, the bottom wall 118 contacts the top of the front wall portion 48 closing the bottom of the front opening 30. A downwardly extending front wall tab 126 snaps past the front wall portion 48 in the closed position and holds the front cover 14 closed. The front cover left wall 116 is the mirror image of the front cover right wall 114. The right wall 114 is connected to the top wall 110, the front wall 112 and the bottom wall 118. The rear edge of the right wall 114 consist of an upper rearward extension 130 and a lower portion 132. The upper rearward extension 130 extends rearwardly beyond the rearward edge of the top wall 110. The upper rearward extension terminates in a semi-circular curved edge 134. A pintle 136 is coaxle with the curved edge 134. The pintle 136 is a short cylindrical button on the inside surface 138 of the upper rearward extension 130. A pintle 140 identical to the pintle 136 is disposed on the inside surface 142 of the upper rearward extension 144 of the left wall 116. The pintles 136, 140 have identical diameter slightly smaller than the inside diameter of the gudgeons 70, 72. As can be seen in FIG. 3, the pintles 136, 140 are normally disposed within the gudgeons 70, 72 and the upper rearward extensions 130, 144 are accommodated in the recessed upper front portions 60. The curved edge 134 of the upper rearward extension 130 is accommodated in the S-shaped curved portion 66 of the recess boundaries 62 allowing the front cover 14 to rotate around the axis pintles and gudgeons. Because the width of the tapered guideways 74, 76 where they intersect the gudgeons 70, 72 is slightly smaller than the diameter of the pintles 136, 140, the front cover 14 is held in place with respect to the main cover 12 when it rotates. However, the front cover 14 can be removed from the main cover 12 by a slight forward directed pressure because of the flexible nature of the material used to form the cover assembly 10 and the appropriately sized width of the tapered guideway 74, 76.

As can be seen in FIGS. 3 and 4, the above described structures allow the cover assembly to be opened in two ways. First, as seen in FIG. 3, the front cover 14 can be simply rotated 90 degrees from a closed position to a open position as indicated by arrow 150. In this arrangement, the front cover 14 is never separated from the main cover 12 and cannot be lost or damaged as by stepping on a dropped cover. By rotating the front cover 14 in a direction opposite to arrow 150, the cover assembly 10 can be closed and locked by action of the tab 126 and front wall portion 48.

Alternatively, as seen in FIG. 4, when there is not sufficient room to allow rotation, the front cover 14 can be separated from the main cover 12 by application of a force in the direction of the arrow 152. This causes the pintle 136 to snap out of the gudgeon 70 completely freeing the front cover 14 from the main cover 12. Because any electrical lights or switches necessarily positioned on the front of the cover assembly 10 are positioned on the front wall portion 48, no electric wires are stretched and potentially damaged in this operation. The front cover 14 is easily reassembled to the main cover 10 by applying a slight force in a direction opposite to the arrow 152. The guideways 74, 76 guide the pintles 136, 140 back into the gudgeons 70, 72 and the tab 126 snaps past the front wall portion 48 locking the cover assembly 10 together.

Preferably, both the main cover 12 and front cover 14 are fabricated from a plastic material as by injection molding. Suitable materials are well known in the art. Such materials are rigid but provide some flexibility allowing the snap action between the gudgeon pintles described above.

The above described structures allows access to adjusting screws 20, 22 and mounting screw 28 through an easily accessible front opening 30, the opening 30 is easily closed to provide a pleasing appearance. The cover assembly is inexpensive to manufacture. While a preferred embodiment of the invention has been described, it should be appreciated that variations thereof will be perceived by those skilled in the art. For instance, the gudgeons 70, 72 need not penetrate entirely through the side walls. It is intended that all such modifications and alterations insofaras they come within the scope of the appended claims or the equivalants thereof be included herein.

Having thus described the invention the following is claimed:

1. A cover assembly for a beverage dispensing valve comprising:

a generally box-shaped main cover comprising a back wall, a top wall, a right side wall, a left side wall, a bottom opening, a front opening and a front cover holder, said front cover holder comprising a gudgeon in said right side wall and a gudgeon in said left side wall;

a front cover adapted to close said front opening being detachably and pivotably engaged by said holder said front cover comprising a front wall, a left wall having a left side inwardly facing surface supporting a left side pintle and a right wall having a right side inwardly facing surface supporting a right side pintle, said pintles comprising button-like protuberances on said inwardly facing surfaces, said pintles being adapted to rotate in said gudgeons and said pintles being adapted to snap into and out of engagement with said gudgeons upon the application of longitudinal force.

2. The cover assembly of claim 1 wherein said gudgeons are holes completely through said side walls and said gudgeons are connected to said front opening by a guideway.

3. The cover assembly of claim 2 wherein said protuberances have a diameter and said guideways have a width tapering from a width greater than said protuberance diameter at said front opening to a width slightly less than said protuberance diameter at said gudgeon.

4. The cover assembly of claim 3 wherein said front cover has a tab remote from said pintles engaging said main cover when said front cover is in a closed position.

5. The cover assembly of claim 4 wherein said main cover has a front wall portion and said tab engages said front wall portion.

6. The cover assembly of claim 3 wherein said left side wall and said right side wall both have planar recess portions adjacent said front opening and said gudgeons are in said recess portions.

7. The cover assembly of claim 6 wherein said gudgeons are near the top of said side walls.

8. The cover assembly of claim 7 wherein said front cover includes a substantially planer generally horizontal top portion, a generally planar right side portion supporting said right side pintle, a generally planar left side portion supporting said left pintle and a front wall.

9. The cover assembly of claim 8 wherein said front cover top portion is generally co-planar with said main cover top wall when said front cover is in a closed position and said front cover right side wall is generally coplanar with said main cover right side wall when said front cover is in said closed position and said front cover left side wall is generally co-planer with said main cover left side wall when said front cover is in said closed position.

10. The cover assembly of claim 1 wherein said main cover additionally comprises a substantially planar front wall portion adapted to receive an electrical component.

11. The cover assembly of claim 10 wherein said front wall portion is disposed below said front opening.

12. A cover assembly for a beverage dispensing valve comprising:

a generally box-shaped main cover comprising a right side wall having a generally flat sidewardly facing surface, a left side wall having a generally flat sidewardly facing surface, a bottom opening and a front opening;

a front cover adapted to close said front opening, said front cover having a front wall, a right side wall having a generally flat sidewardly facing surface, a left side wall having a generally flat sidewardly facing surface, said sidewalls adapted to flex slightly away from one another; and, button-like protuberances on two of said sidewardly facing surfaces and apertures adapted to accept said protuberances on the other two of said sidewardly facing surfaces, whereby said front cover is pivotably and detachably mounted on said main cover.

* * * * *